US006450388B1

(12) United States Patent
Denton

(10) Patent No.: US 6,450,388 B1
(45) Date of Patent: Sep. 17, 2002

(54) RAILROAD TIE PLUG GUN

(76) Inventor: Timothy Vann Denton, 7090 Stonewood Dr., Kennesaw, GA (US) 30152-3370

( * ) Notice: Subject to any disclaimer, the term of this patent is extended or adjusted under 35 U.S.C. 154(b) by 67 days.

(21) Appl. No.: 09/584,998

(22) Filed: Jun. 1, 2000

(51) Int. Cl.[7] ..... B65C 1/02

(52) U.S. Cl. ..... 227/120; 227/147; 173/30; 173/90

(58) Field of Search ..... 227/147, 148, 227/120, 119, 136, 156; 173/90, 30

(56) References Cited

U.S. PATENT DOCUMENTS

| | | | | | |
|---|---|---|---|---|---|
| 47,935 | A | | 5/1865 | Davis | |
| 225,482 | A | | 3/1880 | Mower | |
| 432,113 | A | | 7/1890 | Brady | |
| 650,600 | A | | 5/1900 | Dalpe | |
| 694,649 | A | * | 3/1902 | Kalinowski | 227/147 |
| 1,030,286 | A | * | 6/1912 | Devereaux | 227/147 |
| 2,546,354 | A | * | 3/1951 | Bacon et al. | 227/147 |
| 2,624,879 | A | | 1/1953 | Baird | |
| 3,144,835 | A | | 8/1964 | Pehoski et al. | |
| 4,139,136 | A | * | 2/1979 | Catalano | 227/147 |
| 4,305,541 | A | | 12/1981 | Barrett et al. | |
| 4,494,686 | A | * | 1/1985 | L'Heureux | 227/147 |
| 4,522,127 | A | | 6/1985 | Miller et al. | |
| 4,627,563 | A | * | 12/1986 | Meyer | 227/120 |
| 4,706,864 | A | * | 11/1987 | Jacobsen et al. | 227/120 |
| 4,785,692 | A | | 11/1988 | Holmes | |
| 5,542,355 | A | | 8/1996 | Madison et al. | |
| 5,636,574 | A | | 6/1997 | Pierrot | |
| 6,053,260 | A | * | 4/2000 | Boon et al. | 173/90 |

* cited by examiner

*Primary Examiner*—Scott A. Smith
(74) *Attorney, Agent, or Firm*—Pitts & Brittian, P.C.

(57) ABSTRACT

A manually operated tool is provided for driving elongated plugs into railroad ties. An elongated driver housing, including an upper end and a lower end defines an elongated barrel. A handle is secured to the housing adjacent to the upper end. A reciprocating plunger is slidably mounted within the housing. A handle is secured to the plunger and extends generally perpendicularly from the plunger to extend outwardly through a slot defined longitudinally in the housing. A magazine for storing and sequentially feeding a plurality of plugs into said barrel is located at a position adjacent to the lower end of the housing. The magazine comprises a magazine housing adapted to receive and store a plurality of plugs in a vertical orientation and an advancer slidably mounted within said magazine housing and spring-biased for movement toward the driver housing.

3 Claims, 3 Drawing Sheets

RAILROAD TIE PLUG GUN

CROSS-REFERENCE TO RELATED APPLICATIONS

Not applicable

STATEMENT REGARDING FEDERALLY SPONSORED RESEARCH OR DEVELOPMENT

Not applicable

TECHNICAL FIELD

The present invention relates generally to a tool for inserting plugs into railroad ties after a spike is removed and more particularly to a tool operable from a standing position and having a collapsible magazine adapted to store and sequentially feed plugs into a barrel out of which the plugs are driven into the hole in the railroad tie after a spike has been removed.

BACKGROUND ART

When rails are replaced or re-secured on a railroad track, the old spikes that hold the rail to the ties are removed and new spikes are inserted. It is customary to fill the holes with plugs prior to insertion of the new spikes because otherwise a tight fit may not be achieved and the spike may not securely hold the rail in place. While it is certainly true that a peg can be manually driven into a spike hole with a hammer, this has not proven satisfactory because the plug must be held by hand in the appropriate vertical orientation, which risks damage to the hand of the installer. If the plug is not maintained in the proper vertical orientation, it is frequently damaged by the hammer blows, which is costly in both the time spent and plugs destroyed.

Various types of equipment have been developed for driving plugs and they range in complexity from the simple hand-held tool of U.S. Pat. No. 4,785,692 issued to Holmes on Nov. 22, 1988, to the automatic systems mounted upon self-powered carts disclosed in U.S. Pat. No. 3,144,835 issued to Pehoski et al on Apr. 18, 1964, U.S. Pat. No. 4,522,127 issued to Miller et al on Jun. 11, 1985, and U.S. Pat. No. 5,636,574 issued to Pierrot on Jun. 10, 1997. However, none of the systems provides an inexpensive tool that is operable from a standing position to successively drive multiple plugs into a railroad tie. The Holmes '692 tool must be used in a kneeling or crouched position, which may be acceptable for inserting just a few plugs, but is certainly unacceptable for inserting large numbers of plugs over extended periods of time. Moreover, each time that a plug is driven, the operator must manually feed another plug into the sleeve, from which the plug may be accidently ejected and have to be replaced in the sleeve.

The systems carried on self-propelled carts are exceedingly complex and expensive to build and operate. Therefore they cannot be readily available to multiple sites and repair work must wait until such a cart is available. They are not readily available for emergency repairs either.

Accordingly, it is an object of the present invention to provide a tool for rapidly inserting multiple plugs into holes in railroad ties after spikes have been removed from the ties.

It is also an object of the present invention to provide a tool that is operable from a standing position.

It is a further object to provide a tool that can be stored and transported in a collapsed form and easily restored to an operative condition when it is needed.

These and other objects and advantages of the present invention will become apparent when the following description and claims are considered along with drawings referred to hereinafter.

SUMMARY OF THE INVENTION

Figure 1:
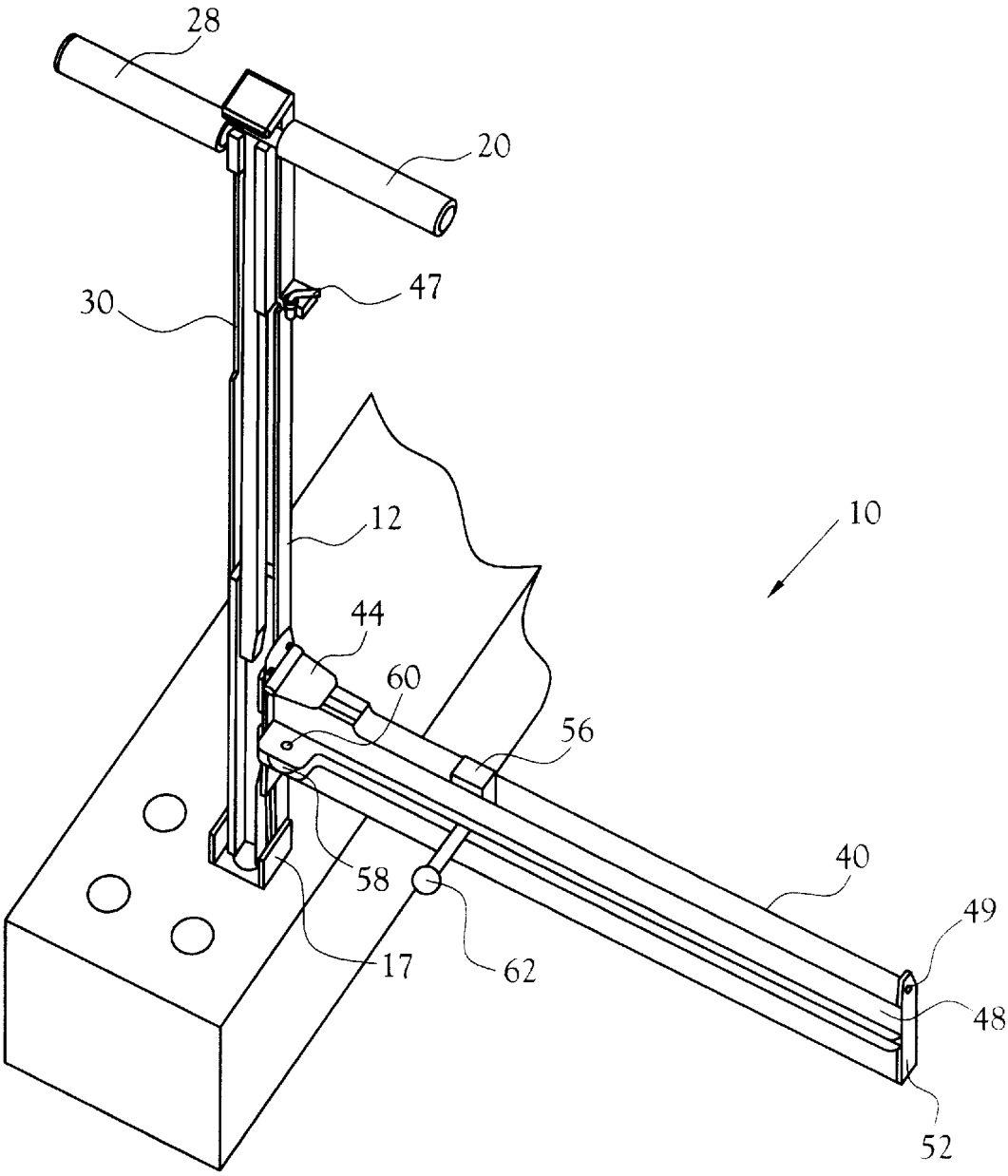
FIG. 1 is a perspective view, partially cutaway, of a plug insertion tool in accordance with the present invention.
Figure 2:
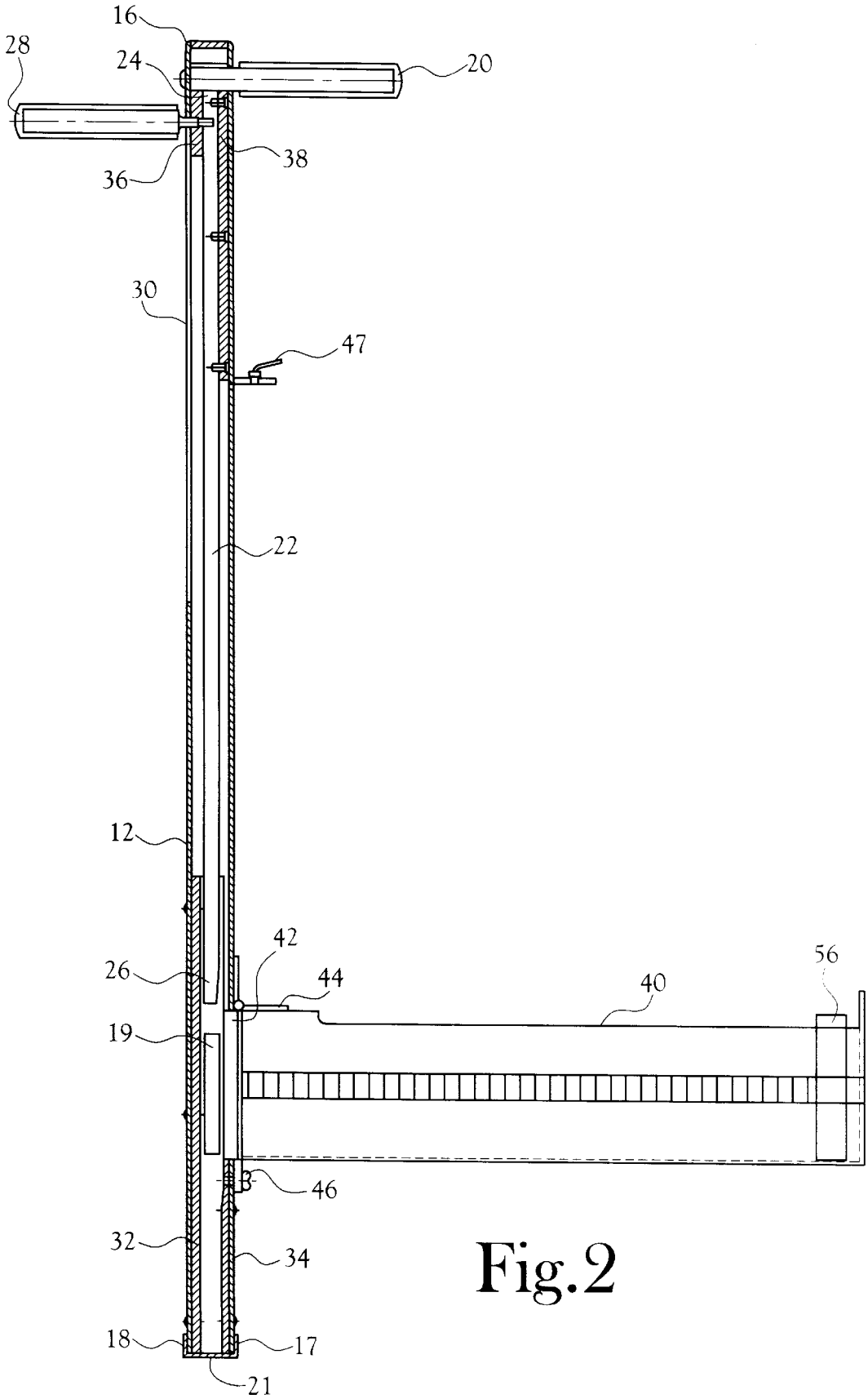
FIG. 2 is an elevation view, partially in cross section, of a plug insertion tool in accordance with the present invention.

In its broader aspects the present invention comprises a tubular housing defining a longitudinal barrel and adapted to be used in a vertical orientation. Within the barrel, a plunger is slidably mounted to move from a position adjacent to the top of the housing to a position adjacent to the bottom of the housing. A handle is secured to the plunger to permit an operator to urge the plunger up and down within the barrel. A magazine adapted to store a plurality of plugs extends laterally from the housing adjacent to an aperture defined within the housing. An advancing mechanism is provided within the magazine to sequentially urge one of the plugs into the barrel each time the plunger is raised to its position adjacent to the top of the housing. When the plunger is lowered, it engages the plug within the barrel to drive it out of the barrel and into a hole in the tie being restored.

DETAILED DESCRIPTION OF THE INVENTION

A plug insertion tool, for restoring railroad ties after the removal of spikes, incorporating various of the features of the present invention is illustrated generally at 10 in the drawings. The tool is designed to allow easy insertion of multiple plugs by an operator in a standing position. The depicted tool 10 comprises an elongated tubular housing 12 that is square in cross-section. The housing 12 in the depicted embodiment is approximately 41 inches long and defines a barrel 14 that is approximately one-inch square in cross-section. The housing 12 has a top end 16 that is closed and a bottom end 18 to which is secured a plate 17 that defines an aperture 21 through which a plug 19, having a square cross-section of about ½ inch by ½ inch or ⅝ inch by ⅝ inch, can pass. A fixed handle 20 extends perpendicularly from the housing 12 at a location adjacent to the top end 16. An elongated plunger 22, having a top end 24 and a bottom end 26, is slidably mounted within the barrel 14 for longitudinal motion along the axis of the barrel 14 between the top end 16 and the bottom end 18 of the housing 12. The plunger 22 is square in cross-section over most of its length, though it is beveled adjacent to its lower end for reasons that will become apparent.

A plunger handle 28 is secured to the plunger 22 at a location adjacent to the top end 24 and extends perpendicularly from the plunger 22 in a direction opposite from the handle 20. The plunger handle 28 extends through a slot 30 defined in the housing 12. The slot 30 is parallel to the longitudinal axis of the housing 12. The slot 30 allows the handle 28 to move up and down with the plunger 22.

Bearings 32 and 34 are secured to the lower portion of the housing 12 within the barrel 14 to maintain the plunger 22 in the center of the barrel as it is raised and lowered within the barrel 14. Similarly, bearings 36 and 38 are secured to the upper portion of the plunger 22 to maintain the plunger in the center of the barrel 14.

Figure 3:
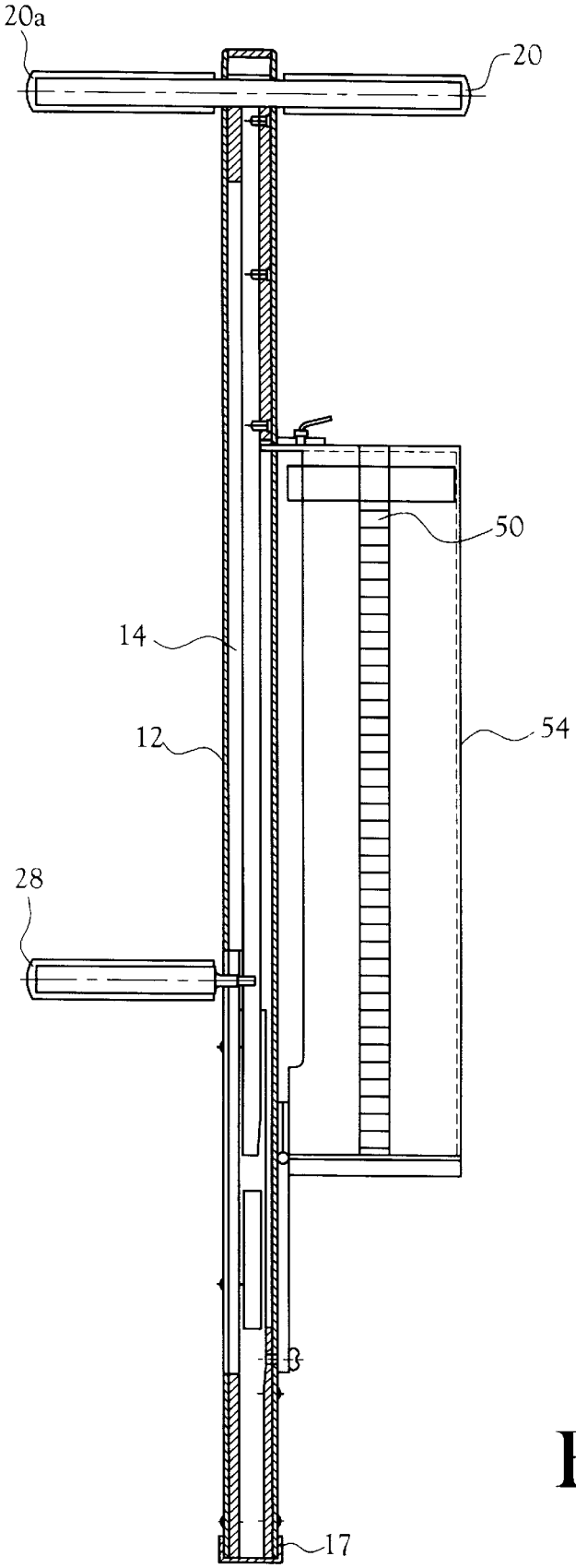
FIG. 3 is an elevation view, partially in cross-section, of an alternative embodiment of a plug insertion tool in accordance with the present invention.

A magazine 40 is attached to the housing 12 adjacent to a slot 42 defined in the housing 12. The slot 42 is parallel to the axis of the barrel 14 and is sized to allow a plug 19 to pass laterally through it while in a vertical orientation. The magazine 40 extends horizontally from the housing 12 when in its operable position and is fixed in that position by a hinge 44 and a wing nut 46. When the wing nut 46 is released, the hinge 44 allows the magazine 40 to pivot to a storage position as shown in FIG. 3 where a storage pin 47 engages an aperture 49 defined in the outboard end of the magazine 40 to retain the magazine in the storage position.

The magazine 40 comprises a first side wall 48, a second side wall 50, an end wall 52 and a bottom wall 54. The side walls 48 and 50 are generally parallel and spaced apart by a distance slightly greater than the width of the plugs 19. The length of the magazine 40 is approximately twenty inches to allow insertion of preferably at least 10 plugs at a time. An advancer 56 is slidably mounted within the magazine 40 for longitudinal movement within the magazine 40. A coil spring 58 is secured at one end to a pin 60 and to the advancer 56 at its other end. A handle 62 is secured to the advancer 56 and extends outwardly through a longitudinal slot defined in the side wall 48 to allow manual retraction of the advancer 56 toward the end wall 52 against the resistance of the coil spring 58 to insert plugs into the magazine 40.

In operation the magazine 40 is released from the storage position by retraction of the pin 47 from the aperture 49 and pivoted to the operative horizontal position where it is secured with the wing nut 46. The advancer 56 is manually retracted away from the housing 12 by the handle 62, against the resistance of the spring 58. A plurality of plugs 19 are inserted into the top of the magazine between the advancer 56 and the housing 12. The plurality of plugs 19 are preferably secured to one another to form a string of parallel plugs 19. Preferably the plugs are secured with staples that pierce the bottom ends of the plugs when they are inserted into the magazine 40. In this manner plugs 19 cannot separate and fall from the magazine 40 through the barrel 14 unless one is intentionally driven from the barrel 14.

The housing 12 is then held in a vertical position over the tie being restored, with the plate 17 resting upon the tie and the aperture 21 located directly over the spike hole. The operator grasps the handle 20 in one hand and grasps the handle 28 in the other hand. Using the handle 28, the plunger is raised to its upper position in which the top end 24 of the plunger 22 is adjacent to the top end 16 of the housing 12 and the bottom end 26 of the plunger 22 is located above the slot 42. The spring-biased advancer 56 urges the string of plugs 19 toward the housing 12, forcing one plug 19 through the slot 42 and into the barrel 14. The plug 19 located within the barrel is prevented from falling through the barrel by its attachment to an adjacent plug 19. The plunger 22 is then forced downwardly through the barrel by manual pressure upon the handle 28. The bottom end of the plunger 22 engages the top of the plug 19 located within the barrel and drives the plug 19 downwardly through the barrel 14 and the aperture 21 in the plate 17 to enter and fill the spike hole located below the aperture 21. As noted herein the bottom end 26 of the plunger 14 is beveled on the side that passes adjacent to the slot 42. In this manner the plunger 22 is prevented from engaging the top of the plug 19 immediately next to the plug located within the barrel 14. Similarly, the upper portion of the bearing 34 is beveled to prevent engagement with the bottom of the plug 19 as it is pushed through the barrel 14.

As required, the plunger 22 may be lifted by the handle 28 as high as the bottom of the slot 42 and lowered again to repeatedly tamp the inserted plug until it is completely enclosed in the spike hole and flush with the top surface of the tie. Thereafter, the plunger 22 is returned to the upper position and the next adjacent plug in the magazine is urged into the barrel for insertion into another spike hole in a similar manner.

After the plugging job has been completed, the wing nut 46 is released and the magazine 40 is pivoted about the hinge 44 to the storage position shown in FIG. 3. The pin 47 is re-inserted and the magazine 40 is thus secured in a collapsed position for storage and transport.

As depicted in FIG. 3 the handle for the plunger 22 may be located adjacent to the bottom of the plunger 22 in a position in which it is operable with a foot rather than a hand. In this embodiment, a second fixed handle 20a is secured to the housing 12. In this embodiment, the operator can use both hands to steady the tool and the strength of the leg can be used to drive the plunger 22.

In accordance with the present invention , a tool is provided for inserting multiple plugs into railway ties after spikes have been removed. The tool is operable from a standing position and is conveniently folded for storage and transportation to remote sites. While a preferred embodiment has been shown and described, it will be understood that it is not intended to limit the disclosure, but rather is intended to cover all modifications and alternate apparatus within the spirit and scope of the invention as set forth in the appended claims.

I claim:

1. A manually operated tool for driving elongated plugs into railroad ties comprising: an elongated driver housing, including an upper end and a lower end and defining an elongated barrel, an outlet for said barrel adjacent said lower end of said driver housing, a handle secured to said housing adjacent to said upper end, a reciprocating plunger, including an upper end and a lower end, slidably mounted within said housing, a handle secured to said upper end of said plunger and extending generally perpendicularly from said plunger to extend outwardly through a slot defined longitudinally in said housing and extending to a location adjacent to said upper end of said driver housing, and a magazine adapted to store and sequentially feed a plurality of plugs into said barrel at a location adjacent to said outlet, said magazine comprising a magazine housing adapted to receive and store a plurality of plugs in a substantially vertical orientation and an advancer slidably mounted within said magazine housing and spring-biased for movement toward said driver housing.

2. A tool as defined in claim 1 wherein said magazine housing is attached to said driver housing by a hinge that allows movement of said magazine housing between an operative position generally perpendicular to said driver housing and a storage position generally parallel to said driver housing.

3. A tool as defined in claim 2 wherein means are provided for alternatively securing said magazine housing in said operative position or said storage position.

* * * * *